US008101068B2

(12) United States Patent
White et al.

(10) Patent No.: US 8,101,068 B2
(45) Date of Patent: Jan. 24, 2012

(54) CONSTANT SPECIFIC GRAVITY HEAT MINIMIZATION

(75) Inventors: John White, Melbourne, FL (US); Mark E. Blue, Palm Bay, FL (US); Derik T. Ehresman, Indialantic, FL (US)

(73) Assignee: Harris Corporation, Melbourne, FL (US)

( * ) Notice: Subject to any disclaimer, the term of this patent is extended or adjusted under 35 U.S.C. 154(b) by 435 days.

(21) Appl. No.: 12/396,192

(22) Filed: Mar. 2, 2009

(65) Prior Publication Data

US 2010/0219106 A1 Sep. 2, 2010

(51) Int. Cl.
*C10G 1/04* (2006.01)

(52) U.S. Cl. ..... 208/391; 208/11; 208/11 LE; 208/390; 209/5; 209/10; 209/166

(58) Field of Classification Search ..... 208/11, 208/11 E, 390, 391, 11 LE; 209/5, 10, 166
See application file for complete search history.

(56) References Cited

U.S. PATENT DOCUMENTS

| | | | | |
|---|---|---|---|---|
| 2,371,459 | A | 3/1945 | Mittelmann | |
| 2,685,930 | A | 8/1954 | Albaugh | |
| 3,004,544 | A | 10/1961 | Guptill | 137/1 |
| 3,497,005 | A | 2/1970 | Pelopsky | |
| 3,530,041 | A | 9/1970 | Erskine et al. | 196/14.52 |
| 3,558,469 | A | 1/1971 | White et al. | 208/11 |
| 3,848,671 | A | 11/1974 | Kern | |
| 3,954,140 | A | 5/1976 | Hendrick | |
| 3,988,036 | A | 10/1976 | Fisher | |
| 3,991,091 | A | 11/1976 | Driscoll | |
| 4,035,282 | A | 7/1977 | Stuchberry et al. | |

(Continued)

FOREIGN PATENT DOCUMENTS

CA 1199573 A1 1/1986

(Continued)

OTHER PUBLICATIONS

"Oil sands." Wikipedia, the free encyclopedia. Retrieved from the Internet from: http://en.wikipedia.org/w/index.php?title=Oil_sands &printable=yes, Feb. 16, 2009.

(Continued)

*Primary Examiner* — Prem C Singh
(74) *Attorney, Agent, or Firm* — Allen, Dyer, Doppelt, Milbrath & Gilchrist, P.A.

(57) ABSTRACT

A process of regulating the water content of water-fluidized oil sand ore during processing of the ore is disclosed. The weight ($m_o$) of a sample charge of oil sand ore having a bulk volume ($V_t$) is determined. The inter granular voids of the sample charge are then filled with water, and the weight ($m_a$) of the added inter granular water is determined. A target specific gravity value ($SG_{mix}$) is selected for the fluidized oil sand ore. The volume of additional water, $\Delta V$, to add to a sample charge of bulk volume $V_t$, to achieve the target specific gravity value ($SG_{mix}$) is calculated by solving the following equation:

$$\Delta V = V_t \cdot \left( \frac{\left( \frac{m_o + m_a}{\rho w \cdot V_t} \right) - SG_{mix}}{SG_{mix} - 1} \right) + \frac{m_a}{\rho w}$$

The determined volume $\Delta V$ of additional water per bulk volume $V_t$ of oil sand ore to be processed is added to the oil sand ore, producing water-fluidized oil sand ore. The ore is then processed to concentrate the bitumen.

18 Claims, 3 Drawing Sheets

U.S. PATENT DOCUMENTS 4,042,487 A 8/1977 Seguchi
4,087,781 A 5/1978 Grossi et al.
4,136,014 A 1/1979 Vermeulen
4,140,179 A 2/1979 Kasevich et al.
4,140,180 A 2/1979 Bridges et al.
4,144,935 A 3/1979 Bridges et al.
4,146,125 A 3/1979 Sanford et al.
4,196,329 A 4/1980 Rowland et al.
4,295,880 A 10/1981 Horner
4,300,219 A 11/1981 Joyal
4,301,865 A 11/1981 Kasevich et al.
4,328,324 A 5/1982 Kock
4,373,581 A 2/1983 Toellner
4,396,062 A 8/1983 Iskander
4,404,123 A 9/1983 Chu
4,410,216 A 10/1983 Allen
4,425,227 A 1/1984 Smith
4,449,585 A 5/1984 Bridges et al.
4,456,065 A 6/1984 Heim
4,457,365 A 7/1984 Kasevich et al.
4,470,459 A 9/1984 Copland
4,485,869 A 12/1984 Sresty
4,487,257 A 12/1984 Dauphine
4,508,168 A 4/1985 Heeren
4,514,305 A 4/1985 Filby
4,524,827 A 6/1985 Bridges
4,531,468 A 7/1985 Simon
4,583,586 A 4/1986 Fujimoto et al.
4,620,593 A 11/1986 Haagensen
4,622,496 A 11/1986 Dattili
4,645,585 A 2/1987 White
4,678,034 A 7/1987 Eastlund
4,703,433 A 10/1987 Sharrit
4,790,375 A 12/1988 Bridges
4,817,711 A 4/1989 Jeambey
4,882,984 A 11/1989 Eves, II
4,892,782 A 1/1990 Fisher et al.
5,046,559 A 9/1991 Glandt
5,055,180 A 10/1991 Klaila
5,065,819 A 11/1991 Kasevich
5,082,054 A 1/1992 Kiamanesh
5,136,249 A 8/1992 White
5,143,598 A * 9/1992 Graham et al. ..... 208/390
5,199,488 A 4/1993 Kasevich
5,233,306 A 8/1993 Misra
5,236,039 A 8/1993 Edelstein
5,251,700 A 10/1993 Nelson
5,293,936 A 3/1994 Bridges
5,304,767 A 4/1994 McGaffigan
5,315,561 A 5/1994 Grossi
5,370,477 A 12/1994 Bunin
5,378,879 A 1/1995 Monovoukas
5,506,592 A 4/1996 MacDonald
5,582,854 A 12/1996 Nosaka
5,621,844 A 4/1997 Bridges
5,631,562 A 5/1997 Cram
5,746,909 A 5/1998 Calta
5,910,287 A 6/1999 Cassin
5,923,299 A 7/1999 Brown et al.
6,045,648 A 4/2000 Palmgren et al.
6,046,464 A 4/2000 Schetzina
6,055,213 A 4/2000 Rubbo
6,063,338 A 5/2000 Pham
6,097,262 A 8/2000 Combellack
6,106,895 A 8/2000 Usuki
6,112,273 A 8/2000 Kau
6,184,427 B1 2/2001 Klepfer
6,229,603 B1 5/2001 Coassin
6,232,114 B1 5/2001 Coassin
6,301,088 B1 10/2001 Nakada
6,303,021 B2 10/2001 Winter
6,348,679 B1 2/2002 Ryan et al.
6,360,819 B1 3/2002 Vinegar
6,432,365 B1 8/2002 Levin
6,603,309 B2 8/2003 Forgang
6,613,678 B1 9/2003 Sakaguchi
6,614,059 B1 9/2003 Tsujimura
6,649,888 B2 11/2003 Ryan et al.
6,712,136 B2 3/2004 de Rouffignac
6,808,935 B2 10/2004 Levin
6,923,273 B2 8/2005 Terry
6,932,155 B2 8/2005 Vinegar
6,967,589 B1 11/2005 Peters
6,992,630 B2 1/2006 Parsche
7,046,584 B2 5/2006 Sorrells
7,079,081 B2 7/2006 Parsche et al.
7,091,460 B2 8/2006 Kinzer
7,109,457 B2 9/2006 Kinzer
7,115,847 B2 10/2006 Kinzer
7,147,057 B2 12/2006 Steele
7,172,038 B2 2/2007 Terry
7,205,947 B2 4/2007 Parsche
7,312,428 B2 12/2007 Kinzer
7,322,416 B2 1/2008 Burris, II
7,337,980 B2 3/2008 Schaedel
7,438,807 B2 10/2008 Garner et al.
7,441,597 B2 10/2008 Kasevich
7,461,693 B2 12/2008 Considine et al.
7,484,561 B2 2/2009 Bridges
7,562,708 B2 7/2009 Cogliandro
7,623,804 B2 11/2009 Sone
2002/0032534 A1 3/2002 Regier
2004/0031731 A1 2/2004 Honeycutt
2005/0199386 A1 9/2005 Kinzer
2005/0274513 A1 12/2005 Schultz
2006/0038083 A1 2/2006 Criswell
2007/0108202 A1 5/2007 Kinzer
2007/0131591 A1 6/2007 Pringle
2007/0137852 A1 6/2007 Considine et al.
2007/0137858 A1 6/2007 Considine et al.
2007/0187089 A1 8/2007 Bridges
2007/0261844 A1 11/2007 Cogliandro et al.
2008/0073079 A1 3/2008 Tranquilla
2008/0143330 A1 6/2008 Madio
2009/0009410 A1 1/2009 Dolgin et al.
2009/0242196 A1 10/2009 Pao

FOREIGN PATENT DOCUMENTS

CA 2678473 8/2009
DE 10 2008 022176 A1 11/2009
EP 0 135 966 4/1985
EP 0418117 A1 3/1991
EP 0563999 A2 10/1993
EP 1106672 A1 6/2001
FR 1586066 A 2/1970
FR 2925519 A1 6/2009
JP 56050119 A 5/1981
JP 2246502 A 10/1990
WO WO 2007/133461 11/2007
WO 2008/011412 A2 1/2008
WO WO 2008/030337 3/2008
WO WO2008098850 A1 8/2008
WO WO2009027262 A1 8/2008
WO WO2009/114934 A1 9/2009

OTHER PUBLICATIONS

Sahni et al., "Electromagnetic Heating Methods for Heavy Oil Reservoirs." 2000 Society of Petroleum Engineers SPE/AAPG Western Regional Meeting, Jun. 19-23, 2000.

Power et al., "Froth Treatment: Past, Present & Future." Oil Sands Symposium, University of Alberta, May 3-5, 2004.

Flint, "Bitumen Recovery Technology A Review of Long Term R&D Opportunities." Jan. 31, 2005. LENEF Consulting (1994) Limited.

"Froth Flotation." Wikipedia, the free encyclopedia. Retrieved from the internet from: http://en.wikipedia.org/wiki/Froth_flotation, Apr. 7, 2009.

"Relative static permittivity." Wikipedia, the free encyclopedia. Retrieved from the Internet from http://en.wikipedia.org/w/index/php?title=Relative_static_permittivity&printable=yes, Feb. 12, 2009.

"Tailings." Wikipedia, the free encyclopedia. Retrieved from the Internet from http://en.wikipedia.org/w/index.php?title=Tailings &printable=yes, Feb. 12, 2009.

U.S. Appl. No. 12/886,338, filed Sep. 20, 2010 (unpublished).

Butler, R.M."Theoretical Studies on the Gravity Drainage of Heavy Oil During In-Situ Steam Heating", Can J. Chem Eng, vol. 59, 1981.
Butler, R. and Mokrys, I., "A New Process (VAPEX) for Recovering Heavy Oils Using Hot Water and Hydrocarbon Vapour", Journal of Canadian Petroleum Technology, 30(1), 97-106, 1991.
Butler, R. and Mokrys, I., "Recovery of Heavy Oils Using Vapourized Hydrocarbon Solvents: Further Development of the VAPEX Process", Journal of Canadian Petroleum Technology, 32(6), 56-62, 1993.
Butler, R. and Mokrys, I., "Closed Loop Extraction Method for the Recovery of Heavy Oils and Bitumens Underlain by Aquifers: the VAPEX Process", Journal of Canadian Petroleum Technology, 37(4), 41-50, 1998.
Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995.
Das, S.K. and Butler, R.M., "Diffusion Coefficients of Propane and Butane in Peace River Bitumen" Canadian Journal of Chemical Engineering, 74, 988-989, Dec. 1996.
Das, S.K. and Butler, R.M., "Mechanism of the Vapour Extraction Process for Heavy Oil and Bitumen", Journal of Petroleum Science and Engineering, 21, 43-59, 1998.
Dunn, S.G., Nenniger, E. and Rajan, R., "A Study of Bitumen Recovery by Gravity Drainage Using Low Temperature Soluble Gas Injection", Canadian Journal of Chemical Engineering, 67, 978-991, Dec. 1989.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 17-24, 1998.
Mokrys, I., and Butler, R., "In Situ Upgrading of Heavy Oils and Bitumen by Propane Deasphalting: The VAPEX Process", SPE 25452, presented at the SPE Production Operations Symposium held in Oklahoma City OK USA, Mar. 21-23, 1993.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta Canada, Jun. 16-18, 2009.
Bridges, J.E., Sresty, G.C., Spencer, H.L. and Wattenbarger, R.A., "Electromagnetic Stimulation of Heavy Oil Wells", 1221-1232, Third International Conference on Heavy Oil Crude and Tar Sands, UNITAR/UNDP, Long Beach California, USA Jul. 22-31, 1985.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008.
Carrizales, M. and Lake, L.W., "Two-Dimensional COMSOL Simulation of Heavy-Oil Recovery by Electromagnetic Heating", Proceedings of the COMSOL Conference Boston, 2009.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992.
Chhetri, A.B. and Islam, M.R., "A Critical Review of Electromagnetic Heating for Enhanced Oil Recovery", Petroleum Science and Technology, 26(14), 1619-1631, 2008.
Chute, F.S., Vermeulen, F.E., Cervenan, M.R. and McVea, F.J., "Electrical Properties of Athabasca Oil Sands", Canadian Journal of Earth Science, 16, 2009-2021, 1979.
Davidson, R.J., "Electromagnetic Stimulation of Lloydminster Heavy Oil Reservoirs", Journal of Canadian Petroleum Technology, 34(4), 15-24, 1995.
Hu, Y., Jha, K.N. and Chakma, A., "Heavy-Oil Recovery from Thin Pay Zones by Electromagnetic Heating", Energy Sources, 21(1-2), 63-73, 1999.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994.
Koolman, M., Huber, N., Diehl, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, Oct. 20-23, 2008.
Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermophysics, 77(6), 1184-1191, 2004.
McGee, B.C.W. and Donaldson, R.D., "Heat Transfer Fundamentals for Electro-thermal Heating of Oil Reservoirs", CIPC 2009-024, presented at the Canadian International Petroleum Conference, held in Calgary, Alberta, Canada Jun. 16-18, 2009.
Ovalles, C., Fonseca, A., Lara, A., Alvarado, V., Urrecheaga, K., Ranson, A. and Mendoza, H., "Opportunities of Downhole Dielectric Heating in Venezuela: Three Case Studies Involving Medium, Heavy and Extra-Heavy Crude Oil Reservoirs" SPE78980, presented at the 2002 SPE International Thermal Operations and Heavy Oil Symposium and International Horizontal Well Technology Conference held in Calgary, Alberta, Canada, Nov. 4-7, 2002.
Rice, S.A., Kok, A.L. and Neate, C.J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.
Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000.
Sayakhov, F.L., Kovaleva, L.A. and Nasyrov, N.M., "Special Features of Heat and Mass Exchange in the Face Zone of Boreholes upon Injection of a Solvent with a Simultaneous Electromagnetic Effect", Journal of Engineering Physics and Thermophysics, 71(1), 161-165, 1998.
Spencer, H.L., Bennett, K.A. and Bridges, J.E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, Aug. 7-12, 1988.
Sresty, G.C., Dev, H., Snow, R.N. and Bridges, J.E., "Recovery of Bitumen from Tar Sand Deposits with the Radio Frequency Process", SPE Reservoir Engineering, 85-94, Jan. 1986.
Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 25-29, 2000.
Schelkunoff, S.K. and Friis, H.T., "Antennas: Theory and Practice", John Wiley & Sons, Inc., London, Chapman Hall, Limited, pp. 229-244, 351-353, 1952.
Gupta, S.C., Gittins, S.D., "Effect of Solvent Sequencing and Other Enhancement on Solvent Aided Process", Journal of Canadian Petroleum Technology, vol. 46, No. 9, pp. 57-61, Sep. 2007.
PCT Notification of Transmittal of the International Search Report and The Written Opinion of the International Searching Authority, or the Declaration, in PCT/US2010/025761, dated Feb. 9, 2011.
PCT Notification of Transmittal of the International Search Report and The Written Opinion of the International Searching Authority, or the Declaration, in PCT/US2010/057090, dated Mar. 3, 2011.
"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm).
Von Hippel, Arthur R., Dielectrics and Waves, Copyright 1954, Library of Congress Catalog Card No. 54-11020, Contents, pp. xi-xii; Chapter II, Section 17, "Polyatomic Molecules", pp. 150-155; Appendix C-E, pp. 273-277, New York, John Wiley and Sons.
United States Patent and Trademark Office, Non-final Office action issued in U.S. Appl. No. 12/396,247, dated Mar. 28, 2011.
United States Patent and Trademark Office, Non-final Office action issued in U.S. Appl. No. 12/396,284, dated Apr. 26, 2011.

Patent Cooperation Treaty, Notification of Transmittal of the International Search Report and The Written Opinion of the International Searching Authority, or the Declaration, in PCT/US2010/025808, dated Apr. 5, 2011.
Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada.
Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of The Institution of Electrical Engineers, © 1986.
Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of The Institution of Electrical Engineers, © 1986.
"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.
Burnhan, "Slow Radio-Frequency Processing of Large Oil Shale Volumes to Produce Petroleum-like Shale Oil," U.S. Department of Energy, Lawrence Livermore National Laboratory, Aug. 20, 2003, UCRL-ID-155045.
Sahni et al., "Electromagnetic Heating Methods for Heavy Oil Reservoirs," U.S. Department of Energy, Lawrence Livermore National Laboratory, May 1, 2000, UCL-JC-138802.
Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
Kinzer, A Review of Notable Intellectual Property for In Situ Electromagnetic Heating of Oil Shale, Quasar Energy LLC.
PCT International Search Report and Written Opinion in PCT/US2010/025765, Jun. 30, 2010.
PCT International Search Report and Written Opinion in PCT/US2010/025772, Aug. 9, 2010.
PCT International Search Report and Written Opinion in PCT/US2010/025763, Jun. 4, 2010.
PCT International Search Report and Written Opinion in PCT/US2010/025807, Jun. 17, 2010.
PCT International Search Report and Written Opinion in PCT/US2010/025804, Jun. 30, 2010.
PCT International Search Report and Written Opinion in PCT/US2010/025769, Jun. 10, 2010.
Carlson et al., "Development of the I IT Research Institute RF Heating Process for In Situ Oil Shale/Tar Sand Fuel Extraction—An Overview", Apr. 1981.
A. Godio: "Open ended-coaxial Cable Measurements of Saturated Sandy Soils", American Journal of Environmental Sciences, vol. 3, No. 3, 2007, pp. 175-182, XP002583544.

* cited by examiner

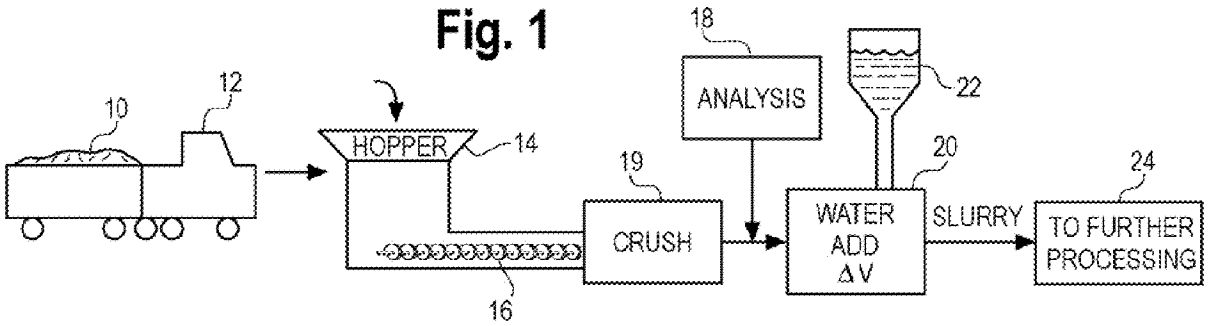
Fig. 1
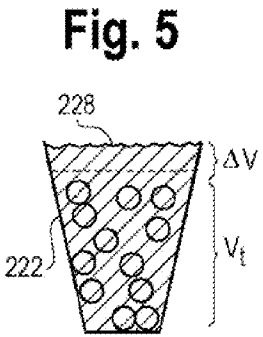
Fig. 3
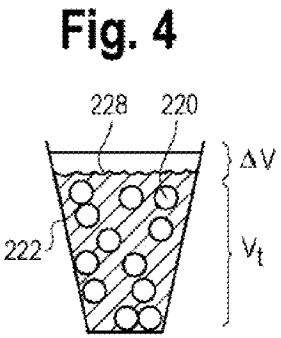
Fig. 4
Fig. 5
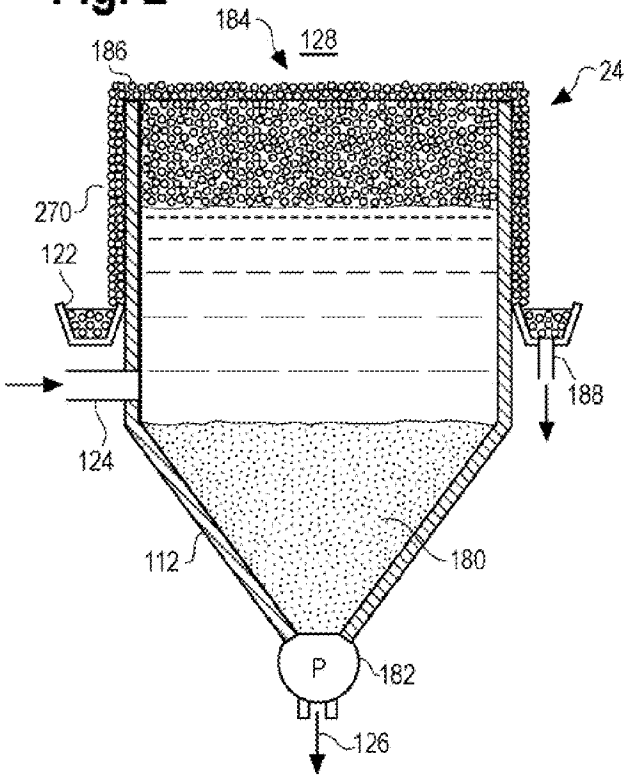
Fig. 2

CONSTANT SPECIFIC GRAVITY HEAT MINIMIZATION

STATEMENT REGARDING FEDERALLY SPONSORED RESEARCH OR DEVELOPMENT

Not Applicable

CROSS REFERENCE TO RELATED APPLICATIONS

This specification is related to McAndrews, Held & Malloy Ser. Nos.:

12/396,247
12/395,995
12/395,945
12/396,021
12/396,284
12/396,057
12/395,953
12/395,918 filed on the same date as this specification, each of which is incorporated by reference herein.

BACKGROUND OF THE INVENTION

The invention concerns processes for refining or otherwise treating oil sand ore, for example oil sand, tar sand, and oil shale, involving admixture of the ore with water to fluidize it during processing.

An oil sand deposit or ore principally contains bitumen, which is a very viscous variety of oil, combined with sand, clay, and water. In oil sand deposits, the bitumen encapsulates sand grains and captures a thin film of water between the grains and the bitumen. This water, known as connate water, is approximately 5% by weight of the ore and represents typical minimum inter granular water content. Additional water exists in the inter granular pore spaces of the ore, and may vary up to 20% by mass of the ore.

The oil sand ore can be processed by mining it from a deposit, combining the ore with water to form a slurry, and hydrotransporting the slurry to equipment for concentrating the bitumen and separating the bitumen from the tailings. "Hydrotransport" is defined as conveying solid/liquid mixtures such as slurries into or through process equipment. The bitumen is then further processed, for example by cracking and distilling, to produce petroleum products.

One known process for concentrating the bitumen, originally developed as the well-known Clarke process, is a froth flotation process in which the slurry is treated with lye (sodium hydroxide), and heated which causes the bitumen to separate from the sand grains and float to the top. The froth generated in the process is bitumen-rich and buoyant, and is removed from the top of the slurry, while the tailings (such as sand) sink to the bottom of the slurry and are removed. The slurry is heated to facilitate the froth flotation process.

Previously, a constant water flow has been added to a constant ore stream in preparation for hydrotransport.

SUMMARY OF THE INVENTION

An aspect of the invention concerns a process of regulating the water content of water-fluidized oil sand ore during processing of the ore.

In the process, a sample charge of comminuted oil sand ore having a bulk volume ($V_t$) and inter granular voids is placed in a container. The weight ($m_o$) of the sample charge is determined. The intergranular voids of the sample charge are then filled with water. ρw is the density of the water. The weight ($m_a$) of the intergranular water is then determined.

A target specific gravity value ($SG_{mix}$) is selected for the fluidized oil sand ore. To consciously achieve the target specific gravity value, it is necessary to determine how much additional water to add. The volume of additional water, ΔV, to add to a sample charge of bulk volume $V_t$, to achieve the target specific gravity value ($SG_{mix}$) is calculated by solving the following equation:

$$\Delta V = V_t \cdot \left( \frac{\left( \frac{m_o + m_a}{\rho w \cdot V_t} \right) - SG_{mix}}{SG_{mix} - 1} \right) + \frac{m_a}{\rho w}$$

The determined volume ΔV of additional water, per bulk volume $V_t$ of oil sand ore to be processed, is added to the oil sand ore. This produces water-fluidized oil sand ore. The water-fluidized oil sand ore is then processed to concentrate the bitumen.

Another aspect of the invention also concerns a process for regulating the water content of water-fluidized oil sand ore during processing of the ore. In this process, the mass fraction of inter granular and connate water in the oil sand ore is determined, as is the mass fraction of bitumen in the oil sand ore. A reference is consulted showing the mass fraction of water initially in the ore, versus the mass fraction of bitumen initially in the ore, versus the mass of water to be added per mass of ore. The mass of water indicated by the reference is added to the ore, producing water-fluidized oil sand ore. The water-fluidized oil sand ore is then processed to concentrate the bitumen.

BRIEF DESCRIPTION OF THE DRAWINGS

FIG. 1 is a schematic view of an exemplary hydrotreating process which can employ an embodiment of the disclosed technology to fluidize oil sand ore.

FIG. 2 is a schematic cutaway view of an exemplary froth flotation process which can be used for concentrating the bitumen in oil sand ore.

FIG. 3 is a schematic view of an oil sand ore sample in a container.

FIG. 4 is a view similar to FIG. 3 in which inter granular water has been added.

FIG. 5 is a view similar to FIG. 4, in which additional water has been added to form a slurry having the desired amount of water for processing.

DETAILED DESCRIPTION OF THE PREFERRED EMBODIMENTS

Figure 6:
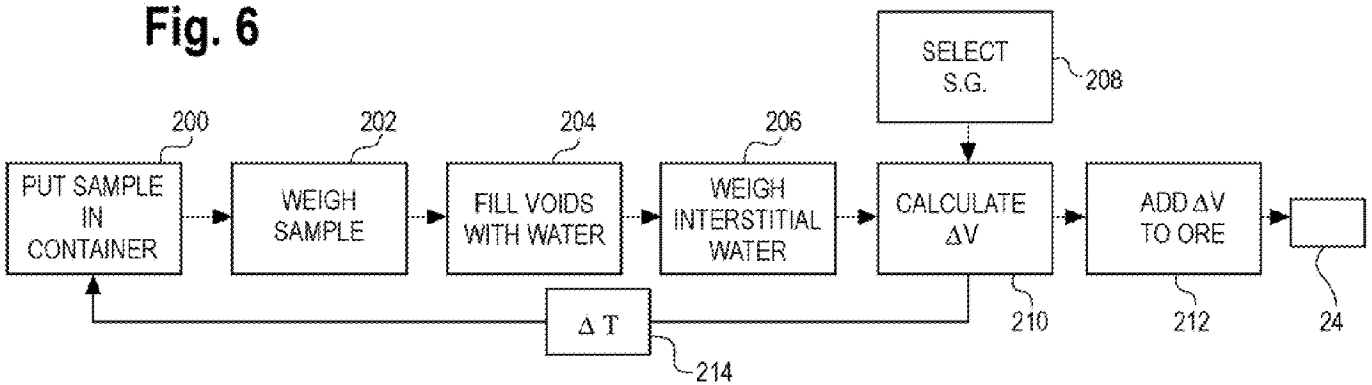
FIG. 6 is a process flow diagram for an embodiment of a method to form a slurry having the desired amount of water.

The present invention will now be described more fully hereinafter with reference to the accompanying drawings, in which one or more embodiments of the invention are shown. This invention may, however, be embodied in many different forms and should not be construed as limited to the embodiments set forth herein. Rather, these embodiments are examples of the invention, which has the full scope indicated by the language of the claims. Like numbers refer to like elements throughout.

FIGS. 1 and 2 show an exemplary environment in which the present technology is useful.

Referring first to FIG. 1, oil sand ore 10 is obtainable, for example, by using a mechanical shovel to mine an oil sand formation. The mined oil sand ore 10 comprises sand coated with water and bitumen. The ore 10 can be deposited into a conveyance, for example a dump truck 12 or other vehicle, to carry the ore 10 to the processing site. On the processing site, the ore 10 can be dumped into a hopper 14 where it is conveyed by a suitable device, such as a screw feeder 16, to and through an analysis station 18 for determination of the amount of water to add to the ore 10 to facilitate further processing. For some types of ore, it may be useful to analyze the ore after the oil sand ore has been comminuted for processing, represented by the station 19.

At the water addition station 20, water 22 is added to the ore 10 to facilitate hydrotreating or conveying the oil sand/water slurry to further processing equipment generally indicated at 24. The ore is combined with water and agitated to produce a sand/water slurry comprising bitumen carried on the sand. Additives such as lye (sodium hydroxide) are added to emulsify the water and the bitumen.

Referring now to FIG. 2, exemplary further processing equipment 24 is shown comprising a primary separation vessel or tank 112 for containing material. The vessel 112 further comprises a launder 122, a feed opening 124, and a drain opening 126. These features adapt the vessel 112 for use as a separation tank to separate froth 128 from the material 114.

The slurry is introduced to the vessel 112 via the feed opening 124, adding to the body of material 114. In the vessel 112, the sand fraction 180 of the material 114 is heavier than the water medium. The sand fraction drops to the bottom of the vessel 112 to form a sand slurry 180 that is removed through the drain opening or sand trap 126. A slurry pump 182 is provided to positively remove the sand slurry 80.

The bitumen per se of the material 114 is heavier than the water medium, but attaches to air bubbles in the vessel 112 to form a bitumen-rich froth. The bitumen froth is floated off of the sand and rises to the top of the slurry. Agitation optionally can be provided in at least the upper portion of the vessel 112, forming bubbles that float the bitumen-rich fraction upward. The top fraction 128 is a froth comprising a bitumen-rich fraction dispersed in water, which in turn has air dispersed in it. The froth is richer in bitumen than the underlying material 114, which is the technical basis for separation.

The bitumen-rich froth 128 is forced upward by the entering material 114 until its surface 184 rises above the weir or lip 186 of the vessel 112. The weir 186 may encircle the entire vessel 112 or be confined to a portion of the circumference of the vessel 112. The froth 128 rising above the level of the weir 86 flows radially outward over the weir 186 and down into the launder 122, and is removed from the launder 122 through a froth drain 188 for further processing.

The specific gravity of the oil sand ore 10 as mined is typically given as 1.2 g/cm$^3$, though specific deposits may have higher or lower specific gravity. Generally speaking, the specific gravity is inversely related to the proportion of water in the ore. Other characteristics of the deposit will also affect the specific gravity, such as the proportion of clay in the ore.

The hydrotransport equipment conveying the slurry from the water addition station 20 adds water to the ore to enable transport of the ore through a pipeline for processing. Previously, a constant water flow has been added to a constant ore stream in preparation for hydrotransport, without considering the amount of water in the ore.

The present inventors have determined that if the ore 10 contains more than the minimum amount of water, reflected by a lower specific gravity, adding a uniform additional quantity of water for hydrotreating introduces extra water that is not needed for hydrotreating (in view of the inter granular water), but must still be heated during subsequent processes that heat the ore slurry. For example, assume adding 600 kg of water per metric ton (1000 kg.) of ore with 5% inter granular water results in a mixture specific gravity (SG) of 1.2, and assume that a SG of 1.2 is low enough to hydrotransport the ore in particular equipment. If this same amount of water is added to ore with 20% inter granular water, the resulting slurry has 250 kg of excess water that is not needed to enable hydrotreating. Heating this excess water to the process temperature wastes energy. Additionally, more water than necessary is output from the process and requires waste treatment or other processing.

The inventors have determined that this problem they have identified can be addressed by metering the amount of hydrotreating water 22 added to the ore 10 according to one or more characteristics of the ore 10. Various characteristics of the ore 10 change in different samples of the oil sand ore 10, and may also change due to environmental factors in the mine (e.g., precipitation, humidity, or water table) or during transport, among other factors. Process conditions like the degree of packing may also affect the specific gravity of the ore.

To address these issues, the inventors have developed a process for regulating the water content of water-fluidized oil sand ore during processing of the ore. FIGS. 3-6 illustrate an embodiment of the process. In particular, refer to FIG. 6 for an overview of the embodiment.

A step 200 can be carried out by putting in a container a sample charge of comminuted oil sand ore having a bulk volume ($V_t$) and inter granular voids. A step 202 can be carried out by determining the weight ($m_o$) of the sample charge. A step 204 can be carried out by filling the inter granular voids of the sample charge with inter granular water, where ρw is the density of the water. A step 206 can be carried out by determining the weight ($m_a$) of the inter granular water. A step 208 can be carried out by selecting a target specific gravity value ($SG_{mix}$) for the fluidized oil sand ore. A step 210 can be carried out by calculating the volume of additional water, ΔV, to add to a sample charge of bulk volume $V_t$, to achieve the target specific gravity value ($SG_{mix}$) by solving the following equation:

$$\Delta V = V_t \cdot \left( \frac{\left( \frac{m_o + m_a}{\rho w \cdot V_t} \right) - SG_{mix}}{SG_{mix} - 1} \right) + \frac{m_a}{\rho w}$$

A step 212 can be carried out by adding the volume ΔV of additional water per bulk volume $V_t$ of oil sand ore to be processed, producing water-fluidized oil sand ore. A step 24 can be carried out by processing the water-fluidized oil sand ore to concentrate the bitumen.

Optionally, the process of FIG. 6 is carried out periodically, either at equal intervals, at certain milestone intervals (such as the start of a shift, after an interruption in processing, when a fresh supply of ore is delivered, or if the ambient temperature changes), at the election of an operator, or at times determined in any other way. In an embodiment, the putting 200, determining 202 and 206, filling 204, and calculating 210 are carried out periodically during the ore processing, thereby periodically updating the value of ΔV.

After a given calculation 210 has been done and an interval of time ΔT has elapsed, represented by the step 214, the process can be repeated. For example, the process can be repeated every minute, every 10 minutes, every hour, every time a new truckload of ore 10 is delivered to the hopper 14 (FIG. 1) and advanced to the analysis station 18, or based on other criteria.

Some other details of various embodiments follow.

The step 200 of putting a quantity $V_t$ of the sample 220 in a container 222 is illustrated by FIG. 3, which shows grains of oil sand ore such as 224 and inter granular spaces such as 226 between the grains such as 224. The size of the inter granular spaces 226 and the separations between the grains such as 224 are exaggerated in FIGS. 3-5 for clarity of illustration.

The step 202 of weighing the sample can be carried out in a variety of ways. For example, in a manual determination the container 222 can be weighed empty, then the sample 220 can be placed in the container, then the container 22 can be re-weighed with the sample 220 and tared by subtracting the weight of the empty container. Alternatively, the sample 220 can be weighed elsewhere, and then transferred to the container 222, reversing the order of the putting and weighing steps 200 and 202.

The step 204 of filling the voids or inter granular space 226 with water can be carried out as illustrated in FIG. 4. This can be done manually, for example by putting water in the container 22 until the surface 228 of the water is level with the top of the sample 220, as illustrated in FIG. 4. The water needed to fill the voids is one component of ΔV. The accuracy of this step can be increased by using a tall, thin container, such as a graduated cylinder or burette as the container 222.

Optionally, during or after the filling step 204, the sample charge 220 can be vibrated to drive out inter granular gases. In an embodiment, vibrating can be carried out by subjecting the sample charge to ultrasonic energy, by agitating the sample charge, or by tapping the container. The container can be vibrated before the filling step 204 as well, for example to pack the sample uniformly before filling the interstices with water.

The weight of the inter granular water can be determined, as called for in step 206 of FIG. 6, in various ways. As one example, the weight of the container 222 and charge 220 before filling the inter granular spaces, as shown in FIG. 3, can be subtracted from the weight of the container 222 and its contents after filling the inter granular spaces, as shown in FIG. 4. In another embodiment, the weight of the inter granular water can be determined by measuring the volume or weight of water added to the container 222 to fill the inter granular spaces.

Step 208 shown in FIG. 6 is carried out by selecting $SG_{mix}$, the intended specific gravity of the oil sand ore/water slurry after adding water. In an embodiment, $SG_{mix}$ can be selected to be at or about the maximum specific gravity, i.e. the minimum amount of water, at which the oil sand ore can be processed. Minimizing the amount of added water, consistent with running the process well, has the advantage of reducing the amount of water to be heated during the process, removed from the process, and treated before recycling or disposing of it. Examples of a suitable $SG_{mix}$ are from 1.42 to 1.6 g/cm$^3$, alternatively from 1.45 to 1.55 g/cm$^3$, alternatively about 1.5 g/cm$^3$. The optimum $SG_{mix}$ for a particular situation can depend, for example, on the processing equipment used, the characteristics of the ore, and the processing temperature.

The desired total water content for the fluidized oil sand ore, including the connate and inter granular water in the ore as provided and the water added to the ore for processing, is a value in the range from about 4% to about 20% by weight, alternatively from about 4% to about 8% by weight, alternatively about 5% by weight.

The selecting step can be carried out at various times. For example, the specific gravity can be selected each time an ore sample is processed, based on process logs or other information regarding how well the process is running. Alternatively, the target specific gravity ($SG_{mix}$) for the fluidized oil sand ore can be maintained at a constant level for multiple iterations of the process. Alternatively, the $SG_{mix}$ can be chosen at the time the processing equipment is designed, and never changed. Selection of the $SG_{mix}$ can be embodied in selection of the processing equipment that provides the $SG_{mix}$. In another embodiment, the selecting step can be carried out by a machine operator or supervisor, based on observation of the process. For example, if an assessment is made that the process could be run with less water, the $SG_{mix}$ can be increased to provide a drier mix, and vice versa if the $SG_{mix}$ appears to be too high at the time.

The selecting step can be carried out in various ways. As one example, the target specific gravity ($SG_{mix}$) can be selected for the fluidized oil sand ore by adopting a published value. As another example, the target specific gravity ($SG_{mix}$) can be selected for the fluidized oil sand ore by analyzing an ore sample to determine how much water needs to be added to achieve the desired total water content, adding that amount of water to the ore sample, and determining the specific gravity of the ore sample with the added water. This can be done, for example, in trial runs of the machine in which the process is run with a set proportion of added water, the run is assessed, and the amount of water added is adjusted to achieve the desired result, such as the minimal energy input for successful processing. A sample of the slurry can then be taken and its specific gravity measured to select the $SG_{mix}$ for the process.

Step 210 shown in FIG. 6 is calculation of the amount of additional water, ΔV, to be added to the oil sand ore per bulk volume $V_t$ of oil sand ore to be processed. This calculation can use as input values the volume $V_t$ of the sand ore sample 220, the weight $m_o$ of the sand ore, the weight $m_a$ of the inter granular water, and the selected value of $SG_{mix}$. The calculation can be carried out by substituting the input values for the sample in the following equation and solving the equation for ΔV:

$$\Delta V = V_t \cdot \left( \frac{\left( \frac{m_o + m_a}{\rho w \cdot V_t} \right) - SG_{mix}}{SG_{mix} - 1} \right) + \frac{m_a}{\rho w}$$

The amount of additional water to be added per bulk volume $V_t$ of oil sand ore can be expressed in terms of the volume or weight of the water to be added.

Step 212 is adding the quantity ΔV of water to the oil sand ore (which has not yet been watered to fill the voids; it is the oil sand ore as mined). The water can be added to the ore batchwise or continuously. An example of batchwise processing as the oil sand ore is provided to be processed is dumping a load 10 of ore from the dump truck 12 (FIG. 1) into the hopper 14, conveying the entire load to the water addition station 20, and metering the desired amount of water 22 into the entire load of ore. An example of carrying out the adding step continuously as the oil sand ore is conveyed to be processed is a small water addition station 20, such as a Y-shaped pipe or vessel having two legs separately and continuously fed with the ore and water and one leg to continuously output the mixture of ore and water.

Another process of regulating the water content of water-fluidized oil sand ore during processing of the ore takes into account an additional factor: the mass fraction of bitumen in the oil sand ore. This method also can employ a different method of determining the amount of water to add to the ore. This process can be carried out as illustrated in FIGS. 7 and 8.

Figure 7:
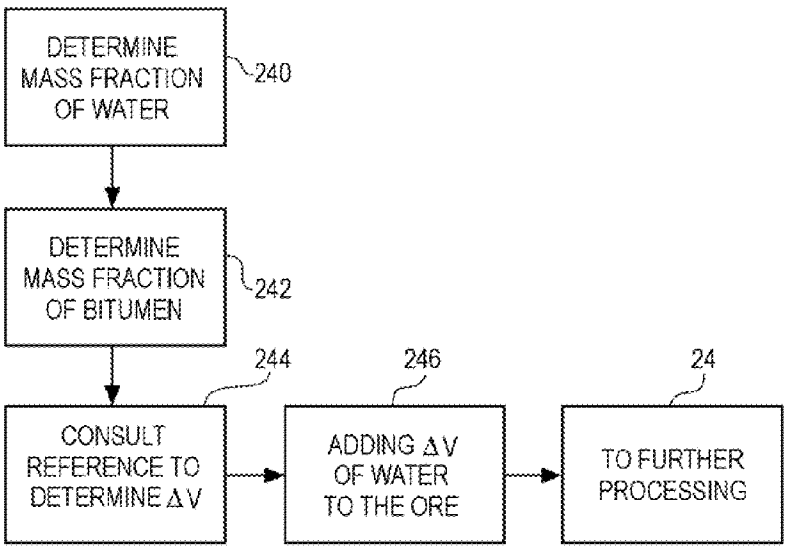
FIG. 7 is a process flow diagram for an alternative embodiment of a method to form a slurry having the desired amount of water.
Figure 8:
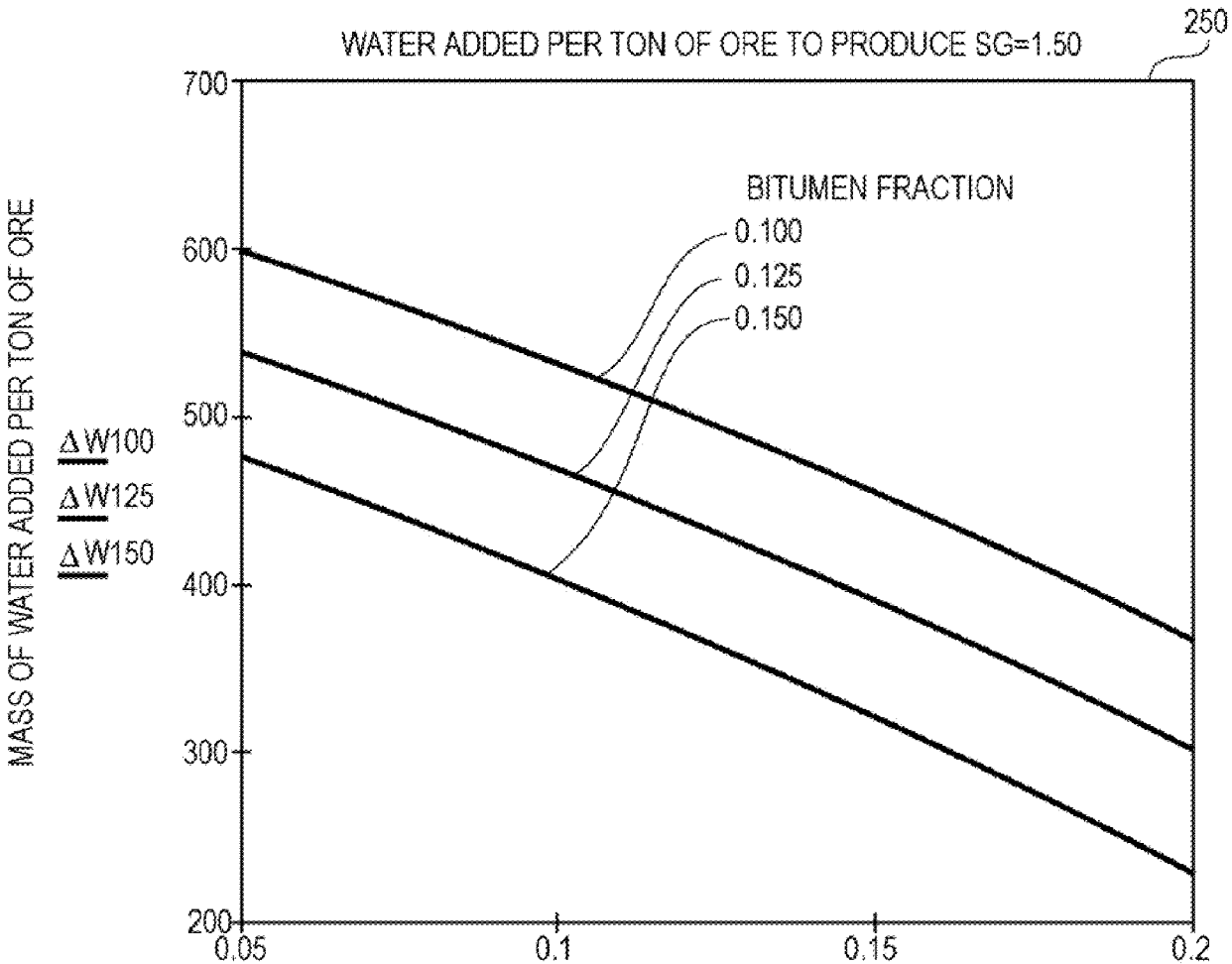
FIG. 8 is a reference plot of the fractions of initial water and bitumen in the oil sand ore, versus the amount of water to be added to the ore.

Referring to FIG. 7, in an embodiment the step 240 is determining the mass fraction of inter granular and connate water in the oil sand ore before water is added to the ore; the step 242 is determining the mass fraction of bitumen in the oil sand ore; the step 244 is consulting a reference to determine the amount of water to add to the oil sand ore, based on the mass fractions of bitumen and inter granular and connate water in the ore; the step 246 is adding an amount of water to the oil sand ore indicated by the reference, producing water-fluidized oil sand ore; and the step 24 is processing the water-fluidized oil sand ore to concentrate the bitumen.

The step 242 of determining the mass fraction of inter granular and connate water in the oil sand ore can be carried out gravimetrically, for example, by removing the water from a sample under conditions that do not substantially disturb the bitumen, as by gentle heating, and weighing the sample before and after heating to determine the amount of water driven off.

The step 240 of determining the mass fraction of bitumen in the oil sand ore is commonly carried out to assay the oil sand deposit and determine whether it is economically valuable to mine and process. Known methods can be used. An exemplary method is pulverizing an ore sample and extracting it with an organic solvent such as naphtha that dissolves the bitumen. The bitumen is then removed from the solvent, as by evaporating the solvent, and the amount of bitumen remaining can be determined gravimetrically by weighing the solvent containing bitumen, evaporating the solvent, and weighing the resulting bitumen.

The step 244 of consulting a reference to determine the amount of water to add to the oil sand ore, based on the mass fractions of bitumen and inter granular and connate water in the ore, can be carried out in various ways. "Reference" is used broadly here to indicate any source of information about the relation between the initial bitumen and water content of the sample and the desired total amount of water in the slurry for processing. The reference can be a plot, a numerical look-up table, a trial to determine the optimum water content of a particular sample of ore, a literature reference, or a record of the amount of water previously used successfully with ore having similar characteristics. Other references of any kind can also be used.

In FIG. 8, for example, the reference 250 is a plot of a family of curves representing various bitumen fractions in the ore. The top curve in the family represents a bitumen fraction of 0.100 or 10% by weight, the middle curve in the family represents a bitumen fraction of 0.125 or 12.5% by weight, and the lowest curve in the family represents a bitumen fraction of 0.150 or 15% by weight. The horizontal axis of the reference 250 is the mass fraction of water in the ore (both connate and inter granular water in the ore), and the vertical axis of the reference 250 indicates how much water to add per ton (1000 kg) of ore.

The reference of FIG. 8 is consulted by finding the curve most closely representing the bitumen fraction of the ore, finding the point on the selected curve above the mass fraction of water measured in the ore, and reading horizontally to the vertical axis to determine how much additional water to add to the ore. The determination can be made more precise by interpolating between two bitumen curves, between two mass fractions of water in the ore, or between two amounts of water to add to the ore.

The step 212 of adding an amount of water to the oil sand ore indicated by the reference, producing water-fluidized oil sand ore, can be carried out in the same way as the corresponding step of FIG. 6.

The step 24 of processing the water-fluidized oil sand ore to concentrate the bitumen can be carried out in the same way as the corresponding step of FIG. 1, 2, or 6.

We claim:

1. A process of regulating water content of oil sand ore comprising:

putting in a container a sample charge of comminuted oil sand ore having a bulk volume ($V_t$) and inter granular voids;

determining the weight ($m_o$) of the sample charge;

filling the inter granular voids of the sample charge with inter granular water, where ρw is the density of the water;

determining the weight ($m_a$) of the inter granular water;

selecting a target specific gravity value ($SG_{mix}$) for the oil sand ore;

calculating the volume of additional water, ΔV, to add to a sample charge of bulk volume $V_t$ to achieve the target specific gravity value ($SG_{mix}$) by solving the following equation:

$$\Delta V = V_t \cdot \left( \frac{\left( \frac{m_o + m_a}{\rho w \cdot V_t} \right) - SG_{mix}}{SG_{mix} - 1} \right) + \frac{m_a}{\rho w}$$

adding the volume ΔV of additional water per bulk volume $V_t$ of oil sand ore to be processed; and processing the oil sand ore including the volume ΔV of additional water to concentrate the bitumen.

2. The process of claim 1, in which $SG_{mix}$ is selected to be at or about the maximum specific gravity at which the oil sand ore can be processed.

3. The process of claim 1, in which the putting, determining, filling, and calculating are carried out periodically during the ore processing, thereby periodically updating the value of ΔV.

4. The process of claim 1, in which the adding can be carried out batchwise as the oil sand ore is provided to be processed.

5. The process of claim 1, in which the adding can be carried out continuously as the oil sand ore is conveyed to be processed.

6. The process of claim 1, in which the weight of the inter granular water is determined by measuring the volume of water added.

7. The process of claim 1, in which the volume ΔV of additional water per bulk volume $V_t$ of oil sand ore to be processed is determined by measuring the weight of water added.

8. The process of claim 1, in which the target specific gravity ($SG_{mix}$) for the oil sand ore is maintained at a constant level for multiple iterations of the process.

9. The process of claim 1, in which the target specific gravity ($SG_{mix}$) is selected for the oil sand ore by adopting a published value.

10. The process of claim 1, in which the target specific gravity ($SG_{mix}$) is selected for the oil sand ore by analyzing an ore sample to determine how much water needs to be added to achieve the desired total water content, adding that amount of water to the ore sample, and determining the specific gravity of the ore sample with the added water.

11. The process of claim 10, in which the desired total water content for the oil sand ore is a value in the range from about 4% to about 20% by weight.

12. The process of claim 10, in which the desired total water content is a value in the range from about 4% to about 8% by weight.

13. The process of claim 10, in which the desired total water content is about 5% by weight.

14. The process of claim 1, further comprising, during or after the filling step, vibrating the sample charge to drive out inter granular gases.

15. The process of claim 14, in which vibrating can be carried out by subjecting the sample charge to ultrasonic energy.

16. The process of claim 14, in which vibrating can be carried out by agitating the sample charge.

17. The process of claim 14, in which vibrating can be carried out by tapping the container.

18. The process of claim 1, carried out after the oil sand ore has been comminuted for processing.

* * * * *